US006786784B2

(12) United States Patent
Charte

(10) Patent No.: US 6,786,784 B2
(45) **Date of Patent: *Sep. 7, 2004**

(54) CHILD'S SAFETY SWIMWEAR

(76) Inventor: Robert A. Charte, Rte. 2, Box 770, Appomattox, VA (US) 24522

( * ) Notice: Subject to any disclaimer, the term of this patent is extended or adjusted under 35 U.S.C. 154(b) by 0 days.

This patent is subject to a terminal disclaimer.

(21) Appl. No.: 10/356,491

(22) Filed: Feb. 3, 2003

(65) Prior Publication Data

US 2003/0139103 A1 Jul. 24, 2003

Related U.S. Application Data

(63) Continuation-in-part of application No. 09/933,763, filed on Aug. 22, 2001, now Pat. No. 6,527,605.

(51) Int. Cl.[7] ..... B63B 22/18
(52) U.S. Cl. ..... 441/26; 441/7

(58) Field of Search ..... 441/5, 7, 23–26, 441/89

(56) References Cited

U.S. PATENT DOCUMENTS 5,037,341 A * 8/1991 Howard ..... 441/89
5,638,581 A * 6/1997 Burke ..... 24/30.5 R

* cited by examiner

*Primary Examiner*—Jesus D. Sotelo
(74) *Attorney, Agent, or Firm*—Duane Morris LLP

(57) ABSTRACT

Safety swimwear with an automatically retractable buoy secured in a manner not interfering with play in and out of the water, the float providing no buoyancy for the child but having sufficient buoyancy to remain on the surface and thus serve as an aid in locating the child whenever the child is submerged. The connector for the float is a permanent part of the swimwear so as to determine the location of the float relative to the wearer and increase the likelihood of the use thereof. In some embodiments, the detachable buoy may take the form of a beach toy.

14 Claims, 5 Drawing Sheets

CHILD'S SAFETY SWIMWEAR

RELATED APPLICATIONS

This application is a continuation-in-part application of U.S. application Ser. No. 09/933,763 filed Aug. 22, 2001 entitled "CHILD LOCATOR BOUY," now U.S. Pat. No. 6,527,605 dated Mar. 4, 2003.

BACKGROUND OF THE INVENTION

The present invention relates to children's safety swimwear and more specifically to swimwear with a locator buoy.

The affinity of children for water is well known and it has long been a problem for parents or other supervisors to know the exact location of their wards at play in venues where the visibility of the water is restricted due to suspended material and/or turbulance, e.g., at swimming holes, on river banks and particularly on crowded seaside beaches. The risk is particularly great for small children playing in the surf where they may be knocked from their feet by a wave and swept away, seaward or up or down the beach, by the ocean currents.

Brightly colored and distinctive clothing is an advantage, but clothing is not always visible to the supervisor as the clothing may be submerged in normal play and of no assistance whatsoever when the child is submerged. Brightly colored floating toys offer some protection. However, it is difficult for a child to freely swim or play in or near the water while maintaining contact with such toys, and they are often discarded. Moreover, such toys are of no assistance in the event a child is inadvertently separated from the toy and in distress.

Brightly colored personal floatation devices such as water wings or life jackets are also helpful but are generally bulky and a great annoyance to the child when playing in and out of the water or merely wading in the surf. In addition, such devices interfere with swimming and playing in deeper waters because of their buoyancy. Children often want to dive in the water and play games that require freedom of motion and unencumbered swimming, and personal floatation devices interfere with such normal play.

There are specialized devices that assist the location of an underwater swimmer or scuba diver. Such devices generally consist of a small float attached to the wrist or ankle of a diver where they can be selectively released by the diver in the event of an underwater emergency to float to the surface and thus mark the location of the diver. By way of example, the Gooding U.S. Pat. No. 4,664,638 discloses a selectively releasable float which may be appropriate for trained divers, but is not appropriate for small children. In addition to the requirement that they have to be released, inadvertent release may be a hazard because the tether does not retract and a child may become entangled in the tether.

There are also flotation devices such as that disclosed in U.S. Pat. No. 5.030,152 which automatically activate upon contact with the water. Such flotation devices are not suitable where contact with the water is anticipated in normal play. Some devices, such as that disclosed in U.S. Pat. No. 4,527,504, provide only a marker float or dye which is automatically activated upon contact with the water. Such devices are not suitable where contact with the water is anticipated in normal play, and the dye tends to become dispersed where there is any wave action.

As shown in the Moore U.S. Pat. No. 1,588,798, it is also known to attach a self winding buoy to the body of a swimmer by a belt secured to the body of the swimmer so that the swimmer may be pulled to the surface by the buoy line, the buoy automatically releasing upon submergence of the swimmer. Such devices are not suitable in monitoring the activities and whereabouts of a child while at play in and near the water and the location of the reel externally of the float presents a safety hazzaard.

Many of these problems have been addressed in applicant's copending application, the disclosure of which is hereby incorporated herein by reference. That application was directed generally to a buoy for selective attachment to the child or to the child's swimwear. However, it has been found advantageous to integrate the buoy with the swimwear to increase the likelihood that the buoy will be worn, to minimize the interference of the buoy with the child's play by dictating its placement on the child, to reduce the likelihood of injury to the child from improper attachment, etc.

It is accordingly an object of the present invention to obviate many of the disadvantages of known children's water safety devices and to provide novel safety swimwear facilitating the location of a child playing in or around water.

It is another object of the present invention to provide swimwear for a child which has a locator buoy which does not interfere with the normal play of the child in or out of the water.

These and many other objects and advantages of the present invention will be readily apparent to one skilled in the art to which the invention pertains from a perusal of the claims when read in conjunction with the appended drawings and the following detailed description of preferred embodiments.

THE DRAWINGS

THE DETAILED DESCRIPTION OF PREFERRED EMBODIMENTS

Figure 1:
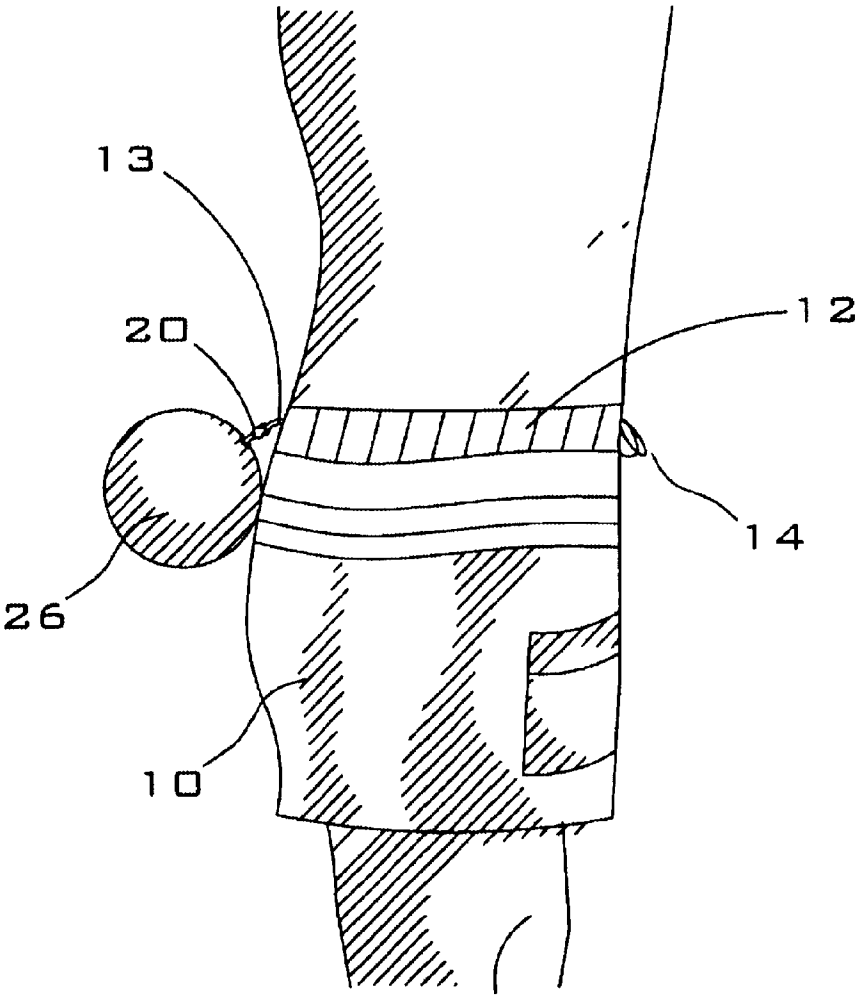
FIG. 1 is a pictorial representation of one embodiment of the swimwear of the present invention, illustrating a float attached to the drawstring of a boy's swim trucks.

An exemplary embodiment of the child's safety swimwear of the present invention is shown in FIG. 1. With reference to FIG. 1, the swimwear comprises conventional swim trunks 10 (boys or girls) with a gathered waistband 12 through which a conventional waist cord 13 passes, exiting the front of the waistband 12 through conventional eyelets (not shown) so that the free ends thereof may be pulled tight around the waist and tied into a bow 14.

Figure 2:
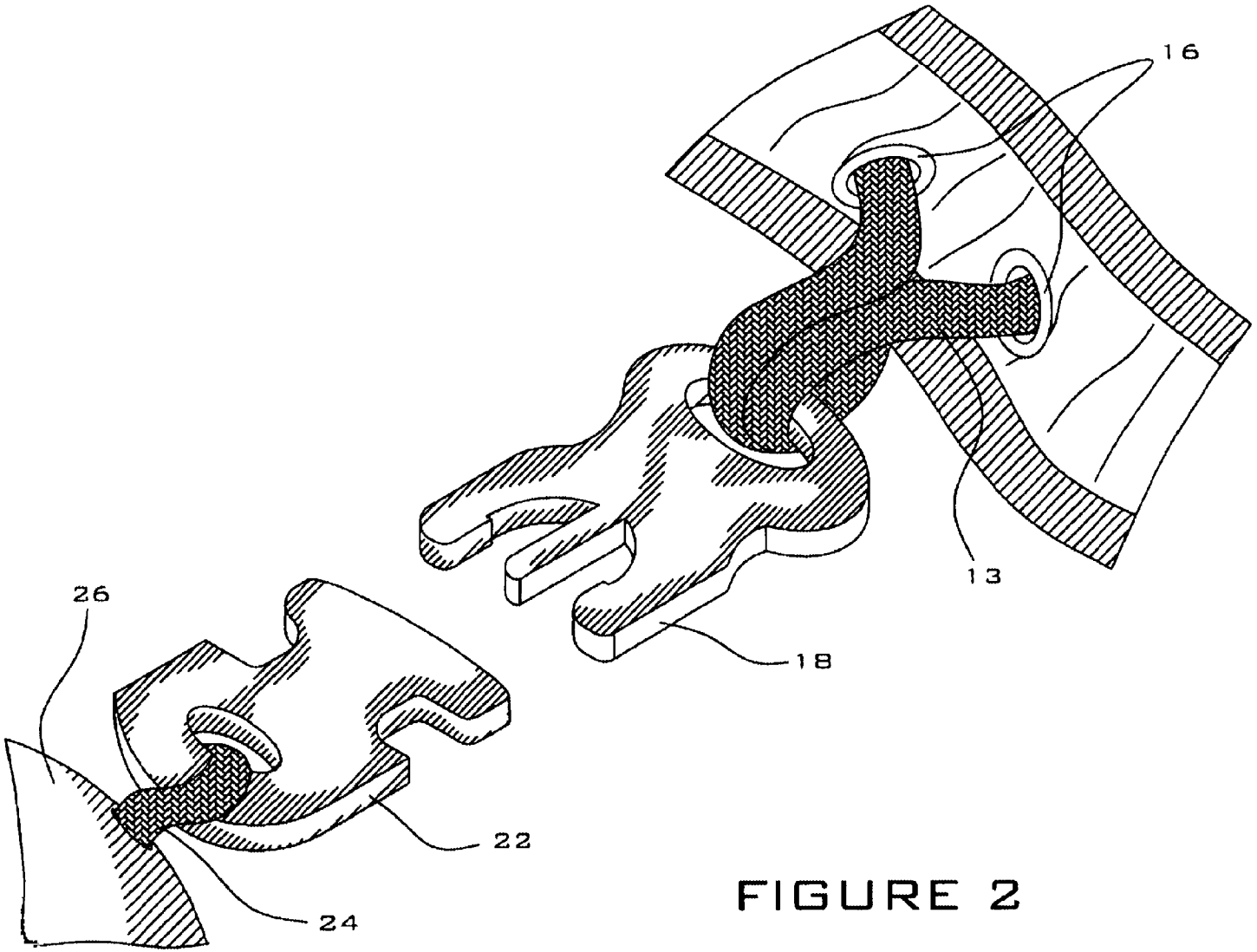
FIG. 2 is a pictorial representation of one embodiment of the connector of FIG. 1 illustrating one method of securing the float to the swimwear adjacent the small of the child's back.

In the embodiment shown, the waist cord 13 also exits the waistband 12 at the rear of the trunks 10 through suitable conventional eyelets or grommets 16 as shown in FIG. 2 where the cord 13 is secured to one half 18 of a suitable conventional connector 20. The other half 22 of the connector 20 is secured to the external or distal end of the tether 24 which enters the float 26. The size of the connector 20 will keep it from entering the float, and the connector 20 may optionally be provided with a locking mechanism to prevent inadvertent disconnection or otherwise resist a child's attempt to disconnect it. A conventional connector of the type shown in FIG. 2 has been found advantageous in that it generally requires two hands to operate it and is difficult for the wearer to operate once the swimwear has been donned.

Since there may be occassions where the trunks will be worn without the connection of the float 26, it is desirable for the portion 18 of the connector 20 permanently attached to the trunks 10 to be the male portion of the connector, preferably devoid of sharp points or other protuberances which might injure the wearer or those with whom the wearer comes in contact. The attachment of the female portion of the connector to the ball is desirable in that children may treat the detached ball as a toy and toss it around when not in the water. If used as a toy, it is of course desirable that the toy not include sharp protuberances.

Figure 6:
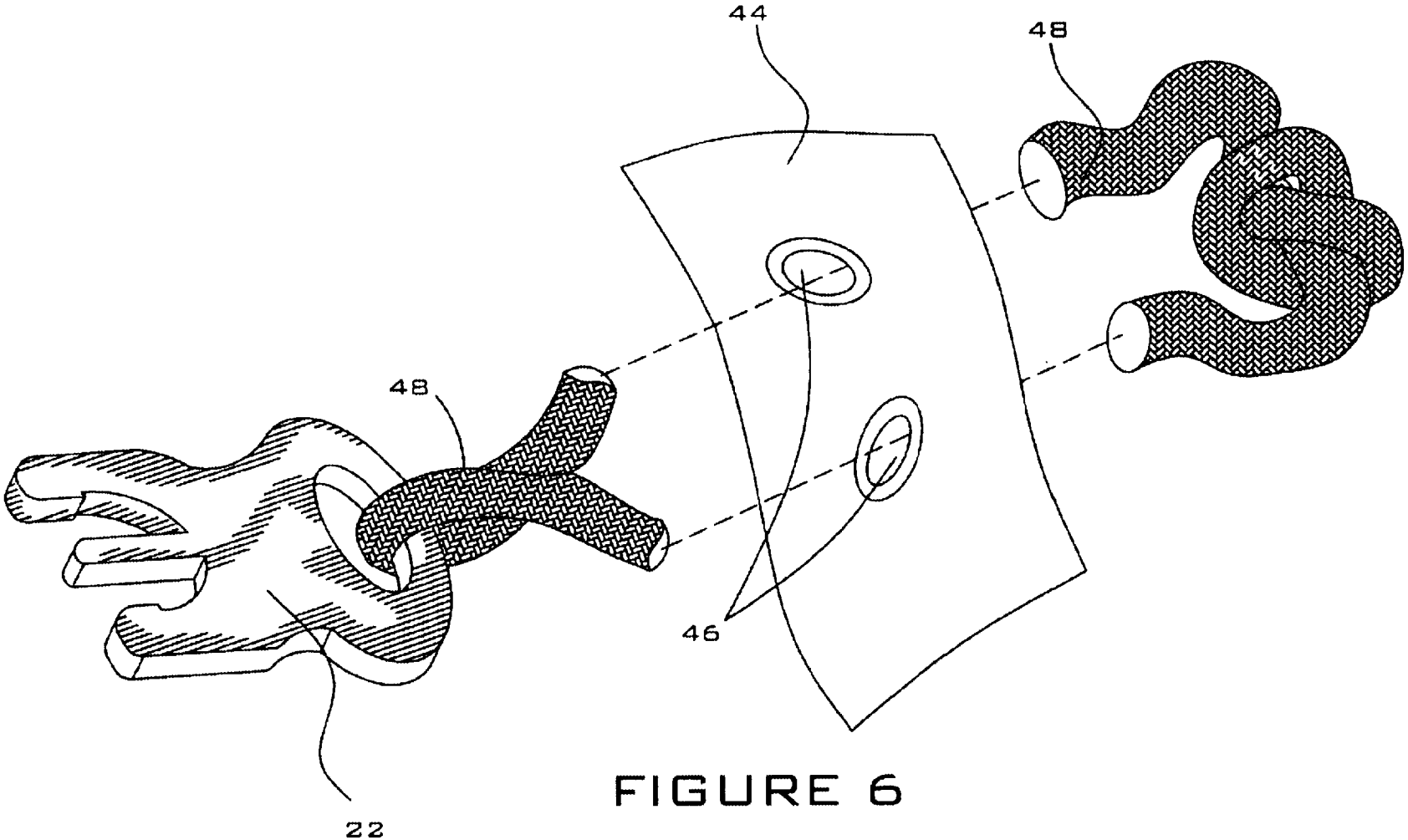
FIG. 6 is a second embodiment of the attachment of the connector to the swimwear.

An alternative to the use of the drawstring of the trucks is a cloth patch 44 as shown in FIG. 6 with apertures through which a string 48 may pass and be knotted or otherwise secured to the swimwear side of the patch 44. The patch may be sewn or glued to the swimwear, and may thus be attached to swimwear without drawstrings such as the conventional one-piece female swimsuit. Of course, a one piece girl's swimsuit may be provided with a drawstring for the purpose of attaching the float.

As explained in greater detail in the above referenced copending application, the fastener or connector 20 forms a releasable connection of the float or buoy 26 to the swimwear 10 of the child. As shown in FIG. 1, the buoy 26 is attached near the small of the child's back is kept in the out-of-the-way retracted position while the child is playing on the beach or wading in the surf. In that position, the buoy 26 does not materially interfere with the child's play.

The submergence of the child a slight distance while swimming may cause the float 26 to extend slightly as the buoyant force overcomes the biasing force of the retractor within the float 26. Because no substantial buoyant force is applied to the child by the buoy 26, the buoy does not materially interfere with normal swimming or play. Should, however, the child be knocked off his feet by a wave, or otherwise be submerged and in distress, the location of the child will be revealed by the float 26 as it remains on the surface of the water against the bias of the retractor. If the period of submergence of the child is brief as with diving in play, the float 26 will retract as the child surfaces permitting normal play to continue.

The swimwear of the present invention is intended to function as a locator for the child, and not as a flotation device. The float 26 remains in an out-of-the-way position unless and until the child is submerged, and automatically resumes that position when the child resurfaces in normal play. Thus the float 26 is substantially non-interfering in normal play, while performing al critical locating function in the unfortunate circumstance that the child experiences distress.

The float 26 is desirably made of a conventional lightweight waterproof material such as a closed-cell foam. The outer shell of the float 26 may be generally spherical, or shaped like a football, or otherwise contoured to rest comfortably adjacent the small of a child's back. The shell is desirably from about six to about twelve inches in the largest dimension and may be covered with an outer plastic skin or shell if desired. A speherical shape has been found aceptable, as has an oblate shape where the horizontal dimension is larger than the vertical dimention.

A color which provides contrast with the water, e.g., blaze orange, is preferred for the shell and/or skin to increase the visibility of the buoy. The distinctive color of the float 26 will, to some extent, aid in locating the child among others in a crowd.

Figure 4:
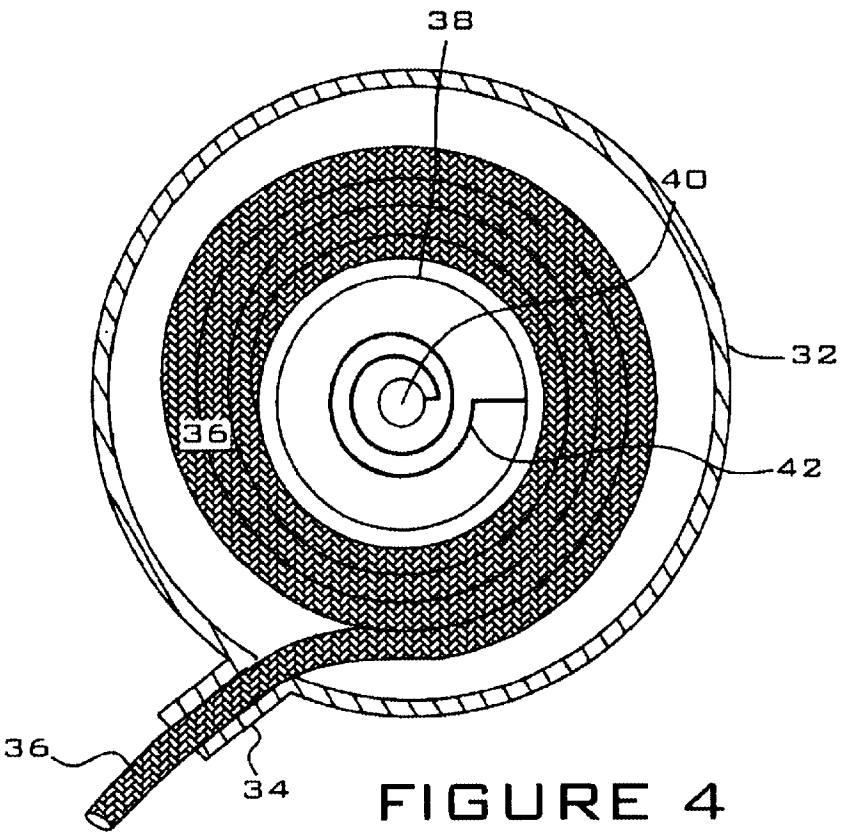
FIG. 4 is section taken through the housing of FIG. 3 exposing the center post and spring which biases the spool of string into a retractable position.
Figure 3:
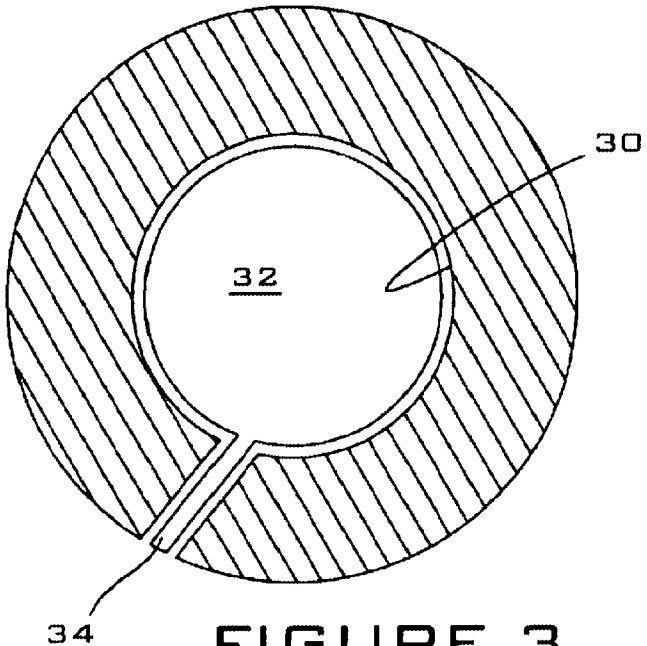
FIG. 3 is a section taken through a diameter of the float illustrating the central cavity within the float and exposing the housing for the retractable string.
Figure 5:
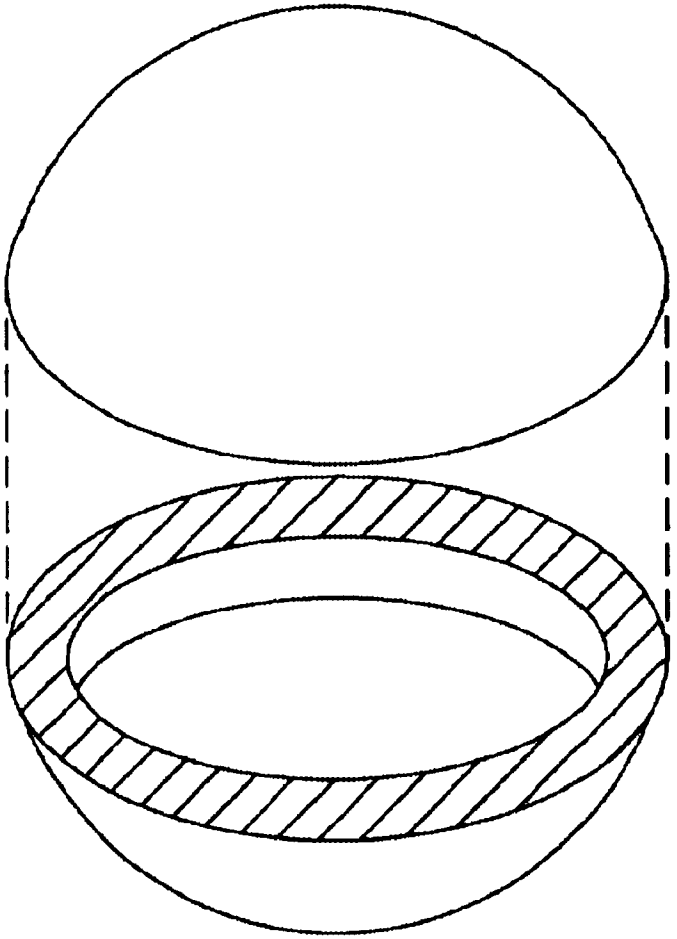
FIG. 5 is an exploded view of the floatation showing the disk shaped cavity therein.

As shown in FIGS. 3 and 4, the float 26 is provided with a central cavity 30 in which the housing for the retractable tether may be located. As shown in FIGS. 3 and 4, the housing 32 may be generally disc shaped and include a nose or spout 34 disposed so as to provide a non-binding entrance for the tether 36 to the reel 38 within the housing 32. Note that the disk shape of the housing, in contrast with a more spheroid chape, permits an increase in the amount of foam which may be included within the float 26 as shown in FIG. 5. This, in turn, permits the use of a smaller volume float and less inconvenience to the wearer without sacrificing floation. As shown in FIG. 4, the internal diameter of the reel 38 is secured to a central post 40 of the housing by a suitable conventional spring 42 which biases the reel to retract the tether 36 into the float 26. It is deisrable that the spring 42 be a constructed so as to provide a constant bias against the withdrawal of the tether 36 from the housing 32 despite the length of the tether which has been withdrawn.

Alternatively, it may be desirable for the spring to exhibit a stepwise or continuously variable bias so the more force is required to withdraw the initial portion, e.g., the first twelve to eighteen inches. This tends to keep the float 26 adjacent the child's back when playing on the surface where the separation is not desired, without inhibiting separation of the float for deeper submergence.

The tether 36 may be made of any suitable conventional flexible cord-like material resistant to exposure to the water and sunlight, preferably lightweight but strong enough to resist breakage under the forces associated with its use. For example, a one hundred pound test monofilament fishing line has been found acceptable. The tether 36 may be of any selected length appropriate for the depth of the water in which the child will be playing, and a length of about 10–15 feet has been found generally acceptable, for example, for a child playing on the beach and in the surf where the mean water level is expected to be between two and four or five feet deep.

The bias provided by the retractor 14 should be sufficient to retain the float 26 snug against the trunk of the child against the force of gravity so that the float 26 does not dangle when the child is out of the water. The density of the flotation material and the volume thereof in the shell should be such that the float 36 remains on the surface of the water against the bias of the retractor, and the bias of the retractor must be sufficient to retain the buoy 10 in the retracted position in air but insufficient to prevent the floatation thereof should the fastener 20 become submerged.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. A child's safety swimwear comprising:

(a) a swimsuit;

(b) a child locator buoy for assisting the location of a child in distress in water where visibility is restricted, said buoy comprising:

(i) a float defining an internal cavity and a passageway to the outer surface thereof, having a shape generally contoured to rest adjacent the small of a child's back and a maximum horizontal dimension at least as great as the maximum vertical dimension, and having an outer surface which sharply contrasts in color with the water, (ii) a spring biased retractor disposed in said internal cavity; and a flexible tether carried by said retractor and extending through said passageway to the outer surface of said float, the weight of said float being insufficient to overcome the bias of said retractor in air so that said float is retained adjacent the small of the child's back so as not to interfere with the play of the child when out of the water and the buoyancy of said float being insufficient to significantly buoy the child so as not to interfere with the normal play of the child in water but sufficient to maintain said float on the surface of the water against the bias of said retractor when the back of the child is submerged so that said float remains on the surface of the water when the child is submerged; and (c) a connector having male and female portions, one of said portions being permanently attached to said swimsuit and the other portion being attached to the distal end of said tether, the visibility of the float thereby aiding in the location of the child when the child is out of the water, swimming or at play on the surface of the water, or under the water.

2. The swimwear of claim 1 wherein said swimsuit includes a drawstring and wherein said connector is permanently attached to said drawstring.

3. The swimwear of claim 1 wherein said connector is permanently attached to said swimsuit by sewing.

4. The swimwear of claim 1 where the portion of said connector attached to said swimsuit is the female portion.

5. The swimwear of claim 1 wherein the bias to the tether provided by said retractor is constant.

6. The swimwear of claim 1 wherein the bias to the tether provided by said retractor is greater for the withdrawal of the initial portion of the tether than for the withdrawal of the remaining oportion of said tether.

7. The swimwear of claim 1 wherein said retractor is housed in a disk-shaped housing.

8. The swimwear of claim 1 wherein said pasageway is angled to reduce the binding of the tether in passing therethrough.

9. The swimwear of claim 1 wherein said connector requires two hands to operate.

10. A child's safety swimwear comprising (a) a child's swimsuit;

(b) a child locator buoy for assisting the location of a child in distress in water where visibility is restricted, said buoy comprising:

(i) a float defining an internal cavity and a passageway extending to the outer surface thereof at an angle which reduces the likelihood of the binding of a tether in passing therethrough, having a shape generally contoured to rest adjacent the small of a child's back and a maximum horizontal dimension at least as great as the maximum vertical dimension, and having an outer surface which sharply contrasts in color with the water;

(ii) a spring biased retractor disposed in said internal cavity; and (iii) a flexible tether carried by said retractor and extending through said passageway to the outer surface of said float, the weight of said float being insufficient to overcome the bias of said retractor in air so that said float is retained adjacent the small of the child's back so as not to interfere with the play of the child when out of the water and the buoyancy of said float being insufficient to significantly buoy the child so as not to interfer with the normal play of the child in water but sufficient to maintain said float on the surface of the water against the bias of said retractor when the back of the child is submerged so that said float remains on the surface of the water when the child is submerged; and (c) a connector having male and female portions, said female portion being permanently attached to said swimsuit and said male portion being attached to the distal end of said tether, the visibility of the float thereby aiding in the location of the child when the child is out of the water, swimming or at play on the surface of the water, or under the water.

11. The swimwear of claim 10 wherein said swimsuit includes a drawstring and wherein said male connector is permanently attached to said drawstring; and wherein said retractor is housed in a disk shaped housing.

12. A child locator buoy for assisting the location of a child in distress in water where visibility is restricted comprising:

a float defining an internal cavity and a passageway to the outer surface thereof, said float having a shape generally contoured to rest in the small of a child's back having the maximum horizontal dimension at least as great as the maximum vertical dimension and having an outer surface of a color which sharply contrasts with water, a spring biased retractor disposed in said internal cavity; and a flexible tether carried by said retractor and extending through said passageway to the outer surface of said float, said tether terminating at the distal end with a fastener adapted for removable attachment to an article of clothing worn by the child such that said float is positioned adjacent to the small of the child's back when the tether is fully retracted, the weight of said float being insufficient to overcome the bias of said retractor in air so that said float is retained adjacent the small of the child's back so as not to interfere with the play of the child when out of the water;

the buoyancy of said float being insufficient to significantly buoy the child so as not to intefere with the normal play of the child in water but sufficient to maintain said float on the surface of the water against the bias of said retractor when the back of the child is submerged so that said float visibly remains on the surface of the water, when the child is submerged, and the visibility of the float thereby aiding in the location of the child when the child is out of the water, swimming or at play on the surface of the water, or under the water.

13. Appartus comprising in combination:

an article of swimwear;

a beach toy;

a selectively releasble connector having a male portion and a female portion, one of said portions being permanently attached to said swimwear and the other portion thereof being attached to said beach toy.

14. The apparatus of claim 13 wherein the portion of said connector attached to said beach toy is a female portion.

* * * * *